United States Patent [19]

Kies

[11] 4,183,606

[45] Jan. 15, 1980

[54] MULTIPLE PLUG-IN CONNECTION

[75] Inventor: Walter Kies, Ditzingen, Fed. Rep. of Germany

[73] Assignee: ECKARDT AG, Fed. Rep. of Germany

[21] Appl. No.: 793,247

[22] Filed: May 3, 1977

[30] Foreign Application Priority Data

May 18, 1976 [DE] Fed. Rep. of Germany ..... 2621979

[51] Int. Cl.[2] ..... H01R 13/54

[52] U.S. Cl. ..... 339/91 R; 339/75 M; 339/184 M

[58] Field of Search ..... 339/75 R, 75 M, 91 R, 339/75 MP, 17 OR, 17 LC, 176 M

[56] References Cited

U.S. PATENT DOCUMENTS

| | | | |
|---|---|---|---|
| 3,188,598 | 6/1965 | Pferd | 339/75 MP X |
| 3,216,580 | 11/1965 | Fricker | 339/75 MP |
| 3,345,604 | 10/1967 | Henschen et al. | 339/75 M X |
| 3,413,594 | 11/1968 | Fernald et al. | 339/17 LC X |
| 3,644,870 | 2/1972 | Jones | 339/176 M X |
| 3,668,605 | 6/1972 | Albert | 339/75 M X |
| 3,915,307 | 10/1975 | Agarde | 339/17 M X |
| 3,932,016 | 1/1976 | Ammenheuser | 339/75 MP X |

*Primary Examiner*—E. F. Desmond

*Attorney, Agent, or Firm*—Craig and Antonelli

[57] ABSTRACT

A multiple plug-in connector device is constructed as a plurality of connector housings, each including connector elements, such as sockets, and each being mounted in frame structure for guidable movement toward and away from a plug connection providing a plurality of plug pins.

23 Claims, 2 Drawing Figures

MULTIPLE PLUG-IN CONNECTION

Figure 1:
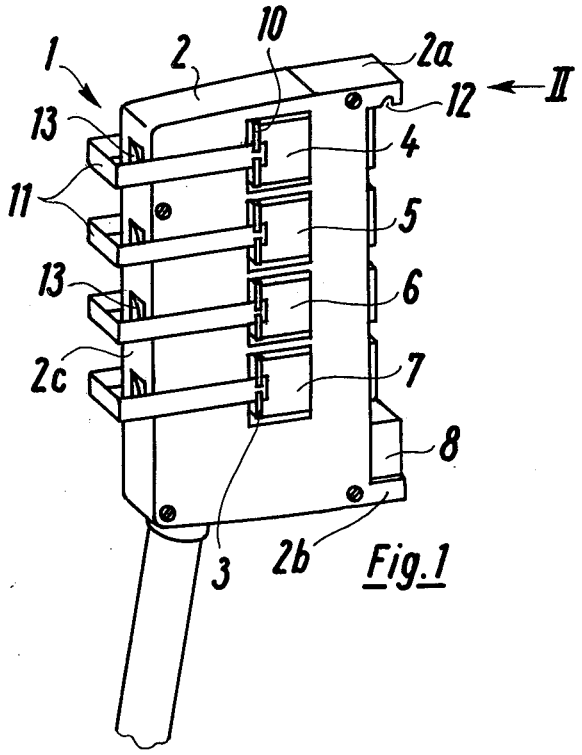

The invention relates to a multiple plug-in connection device, especially for codable socket connectors for plug connections to switch boxes which are provided with plug pins that are combined into a plug housing, such as described in my copending application, Ser. No. 793,248, filed concurrently herewith, now U.S. Pat. No. 4,148,545, issued Apr. 10, 1979. Various arrangements of multiple plug connections have been previously contemplated. As a rule, they consist of fixed housings made of insulating material in which plug pins or tongues are fixedly disposed parallel to each other, and at a specific distance from each other. The multiple plug pins can be connected in common in switch boxes or instruments to corresponding plug-socket connections by means of the housing. Such multiple plug connections have the advantage that the plug-socket connection can be coded, i.e. cannot be confused with another plug-socket arrangement, so that the plug will only be adapted to the associated connection.

However, these previous constructions cannot be used in all cases, and they also have limitations insofar as the number of connections that can be established is concerned, particularly if the contact tongues must have specific dimensions for electrical or mechanical reasons, as in the connection of switch boxes of automatic control and regulating facilities. The drawback then occurs that, because of the friction forces arising during the connecting process between the contact tongues and the connecting points, the total force for plugging-in reaches such magnitudes that it cannot be managed by hand. The number of plug connecting points to be managed with multiple plug-socket connections is limited for this reason, especially for switch box connections in automatic control and regulating devices. In the conventional "19-inch" technique, where the contact pins or tongues may be about 6.3 mm wide, no more than eitht to ten connection points can be connected simultaneously. For this reason, ordinary soldered connections are preponderantly used today for building these switch boxes.

The present invention is concerned with the problem of producing multiple plug-in connections made in such a way that, even in those cases that have been mentioned where it has not been possible to use plug-socket connections, there will be a codable association of the greatest possible number of connecting places without confusion, and without the disadvantage of large actuating forces.

These advantages of the present invention for multiple plug-socket connections are achieved by several connector housings being movable parallel to each other in a common guide frame in which housings a plurality of socket connectors for plug connections is associated. By this arrangement, there results a multiple plug-in connection device in which a great number of connecting places is produced in association with a single common setting of the guide frame on corresponding racks with the socket connectors or plug connections, where, however, the connecting force is applied in the unitary movement of the housings which, for example, can be pushed in one after the other, and which, respectively, join only as many plug-in connections as can be efficiently managed by hand. The great advantage of a multiple plug-in connection of this sort is a substantial simplification in assembly, and additionally several connector housings can be preassembled, so that coded connections eliminating confusion can be established even for great numbers of plug-in connections without contact losses, which was impossible to such an extent heretofore.

It is advantageous if each guide frame corresponds about to the width of a plug-in connector housing, and if the housings are disposed one below the other in a column with the side surfaces being guided in the guide frame. This embodiment makes it possible to arrange a whole series of multiple plug-in connections according to the invention close to each other, where it is structurally advantageous if the guide frame be provided as a U-shaped member with at least two connecting walls that cover the arms of the U at the sides. With this arrangement, the housing can have a square cross section and can be set in selectively in the guide frame turned by 90°, so that coding of the connections is possible in a very simple way. Each connector housing in this embodiment can be connected with an actuating arcuate member that extends behind the crosspiece of the U-shaped guide frame, and allows a movement of the housing in the guide tracks from the back of the guide frame. This allows connection or release of the individual housing even if several guide frames of the invention are disposed close to each other, although the connector elements themselves are not accessible from the side of the guide frame.

Release of the connections is advantageously achieved if the crosspiece of the U-shaped guide frame is provided with depressions for the introduction of tools between an actuating arcuate member and the guide tracks at those places where the actuating arcuate member can be applied. Finally, the guide frame may have a suspension or lock device at one end, advantageously the upper end, of its arm that is turned toward the plug connections, for fastening on the rack that receives the plug connections, so that it suffices, for completing the plug connection, to hang the guide frame at the top and only press the lowermost connector element. In this arrangement, therefore, it is sufficient if the lowermost of the movable connector housings is fixed in the guide frame in a position such that, when the guide frame is pushed against the rack, the plug connection will be established since the lowermost connector housing can then be pushed-in onto the plug pins after suspension of the guide frame. Finally, the other connector elements can be connected to the respective plug connectors one after the other.

Figure 2:
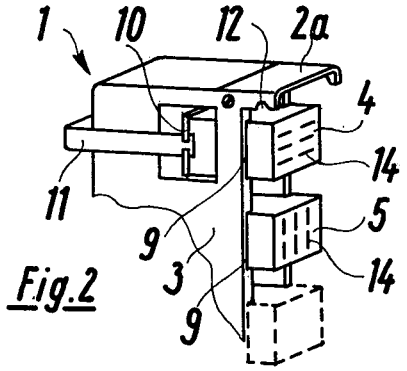

These and other features, advantages and objects of the present invention will become more apparent from the following description when taken in connection with the accompanying drawing which shows, for purposes of illustration only, an embodiment in accordance with the present invention, and wherein:

FIG. 1 is a schematic, perspective view of a multiple plug-in connector device according to the present invention, and FIG. 2 is a partial, perspective illustration of the connector of FIG. 1 in the direction of arrow II.

In the drawing where like reference numerals designate like parts, a multiple plug-in connector device is shown comprising essentially a U-shaped arcuate frame member 2 having two arms 2*a* and 2*b* covered at the sides by connecting walls 3, and a plurality of individual plug-in connector elements 4, 5, 6, 7, 8 can be disposed in the space enclosed by U-shaped frame element 2. Guide tracks 9, as seen in FIG. 2, are provided in the side walls 3 for each connector housing 4 to 7, which are identical in cross section. These guide tracks essentially comprise groovelike recesses in the side walls 3, or in parts thereof. The side walls of the connector housings 4 to 7 are slidingly guided in the guide tracks 9, so that each of the housings 4 to 7 can be moved from an inner position, illustrated in FIG. 1, to a position far to the right, as indicated by the element 8, such that the front face, which is not visible in FIG. 1, will be aligned with the front edge of ends 2a and 2b of U-shaped frame element 2. Lowermost connector element 8 is fixedly disposed in the illustrated embodiment and cannot be moved.

Connector housings 4 to 7 may include an edge 10 encircling the respective rear ends, and free ends of another U-shaped member 11 are suspended in the edges 10 at the sides. Each U-shaped member 11 is secured in position, and the lateral arms bear along side walls 3 for guiding the connector housings. It is also possible to provide guide grooves on the outer surfaces of side walls 3 for the arms of U-shaped element 11 to move along.

U-shaped frame member 2 presents a downwardly directed recess 12 on the upper end 2a which faces toward a plug connector (not shown), by which the multiple plug-in connector device of the present invention can be hung on a rack which includes the plug connector having plug tongues to be associated with housings 4 to 8. On portion 2c of the arcuate frame member 2, which faces away from ends 2a and 2b, depressions 13 are provided in the zones at which the crosspiece ends of members 11 bear. These depressions on arcuate frame member 2 have a length somewhat greater than the width of members 11, so that, for example, the tip of a screwdriver can be introduced into these depressions to bring the members 11 back into the position, as shown in FIG. 1. Thus, a member 11 along with its associated plug-in housing, can be pulled back from the connected position where the individual plug-in housings are flush with the front surface of connector element 8 in the plane of the ends of arms 2a and 2b.

In FIG. 2, plug-in connector housings 4 to 8 are provided with a square cross section so that it is possible to also insert them into guide tracks 9, even after they have been turned by 90°. Since each connector housing in the illustrated embodiment has slitlike socket openings 14 arranged in two or three tracks to accept corresponding contact plug pins or tongues of a plug connector (not illustrated), rotation of the connector housings 4 through 8 allows a different coding for each multiple connector device 1. It is also possible, of course, to associate crossed socket openings with each respective connector housing of the present invention, so that each socket opening would offer two possible connections, and thus, increase the codability. It has been found in practice that the arrangement illustrated in FIGS. 1 and 2 is by itself adequate.

Thus, for example, the use of thirty-two multiple plug-in connector devices, according to the present invention, with five connector elements, each with six connection possibilities, creates the possibility of having connections to switch boxes by eight multiple connector devices of the present invention adjacent to each other in a row and four devices one below the other in a column for a total of 960 lines, which number is sufficient for connection of switching fields for kinds that are known. Since the various connector housings of the present invention can be turned by 90°, it is also possible to have a different coding for all guide frames of the multiple plug-in connector devices, and the switching fields of switch boxes or the like can be codably wired, such that an essentially simple assembly results. Thus, for example, the connection of 960 connecting places can be effected by only one person in a relatively short time, because the plug-in connector devices of the present invention and the associated connection points can be preassembled and wired in the shop. The danger of confusion of connections or of an excessive outlay for installation is thereby avoided. Since in general such wiring has to be done twice in setting up a switch box, once when the switch box is received in the plant, and again when it is installed operationally, the invention offers a considerable simplification.

While I have shown and described one embodiment in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

I claim:

1. A multiple connector device for codable socket connectors with a plurality of plug pins, said device comprising a plurality of socket members each including a plurality of socket connections, and a common frame means for holding each of said plurality of socket members in relatively displaceable parallel positions with respect to one another, each of said plurality of socket members being individually movable within said frame means parallel to one another and an additional socket member in said frame means which is fixed at a predetermined position.

2. A multiple connector device for codable plug-in connections with a plurality of plug pins, characterized in that several plug-in connector housing means are disposed movably parallel to each other in a common guide frame means, and a plurality of connecting means is associated with each connector housing means, characterized in that the guide frame means includes a U-shaped arcuate frame means and at least two connecting wall means that laterally cover arms of the U-shaped frame means, said wall means being provided with guide tracks for guiding a respective housing means, and characterized in that the connector housing means have a square cross section, and are selectively oriented by 90° with respect to one another for insertion in the guide tracks.

3. A multiple connector device for codable plug-in connections with a plurality of plug pins, characterized in that several plug-in connector housing means are disposed movably parallel to each other within a common guide frame means, and a plurality of connecting means is associated with each connector housing means, wherein said several plug-in connector housing means are individually movable in the direction of insertion of said connecting means, and in that the guide frame means includes a U-shaped arcuate frame means and at least two connecting wall means that laterally cover arms of the U-shaped frame means, said wall means being provided with guide tracks for guiding a respective housing means.

4. A multiple connector device as in claim 3, characterized in that each connector housing means is associated with actuating means for moving the connector housing means in the guide tracks from the back of the guide frame means.

5. A multiple connector device as in claim 4, characterized in that the actuating means includes an arcuate member extending around a crosspiece at the back of the guide frame means.

6. A multiple connector device as in claim 5, characterized in that the crosspiece of the U-shaped guide frame means includes a depression for insertion of tools or the like between the arcuate actuating member and the guide frame means at respective portions where the actuating arcuate members are provided.

7. A multiple connector device for codable plug-in connections with a plurality of plug pins, characterized in that several plug-in connector housing means are disposed movably parallel to each other in a common guide frame means, and a plurality of connecting means is associated with each connector housing means, characterized in that the guide frame means includes a U-shaped arcuate frame means and at least two connecting wall means that laterally cover arms of the U-shaped frame means, said wall means being provided with guide tracks for guiding a respective housing means, characterized in that each of said several connector housing means is associated with actuating means for moving the connector housing means in the guide tracks from the back of the guide frame means, characterized in that the actuating means includes an arcuate member extending around a crosspiece at the back of the guide frame means, characterized in that the crosspiece of the U-shaped guide frame means includes a depression for insertion of tools or the like between the arcuate actuating member and the guide frame means at respective portions where the actuating arcuate members are provided, and characterized in that an additional connector housing means is fixedly disposed in the guide frame means at a position in which engagement of corresponding plug pins can be established when the guide frame means is pushed against the means for providing the plug pins.

8. A multiple connector device for codable plug-in connections with a plurality of plug pins, characterized in that several plug-in connector housing means are disposed movably parallel to each other within a common guide frame means, and a plurality of connecting means is associated with each connector housing means, wherein said several plug-in connector housing means are individually displaceable within said frame means in the direction of movement of said connecting means, characterized in that the guide frame means includes locking means for mounting said multiple connector device at means for providing the plug pins, said locking means being arranged on at least one end of said guide frame means and characterized in that one connector housing means is fixedly disposed in the guide frame means at a position spaced from said locking means at which position engagement of corresponding plug pins is established when the guide frame means is pushed against the means for providing the plug pins.

9. A multiple plug connector device comprising a frame, and a contact plug-in connector carrier providing a plurality of contact plug-in connectors, wherein said contact plug-in connector carrier is divided into several plug-in members being separated by planes of division which are parallel to a direction of insertion into said plug-in connectors, and wherein said several plug-in members are individually displaceable in the direction of insertion within said frame, wherein said several plug-in members have a square cross-section, and are incorporated in guide members of said frame and selectively oriented by 90° with respect to one another.

10. A multiple plug connector according to claim 9, wherein said frame consists of a U-shaped bracket with at least two end walls laterally overlapping sides of the U portion of said bracket, said end walls having guideways for each of said several plug-in members.

11. A multiple plug connector device according to claim 9, wherein said frame has, at least at an upper end, a suspension member for fastening to another frame holding multiple plug connectors.

12. A multiple plug connector device according to claim 11, wherein one of said several plug-in members being at a lower part of said contact plug-in connector carrier is arranged firmly in said frame at a position in which joining of a plug member occurs when said multiple plug connectors press against said frame of said plug-in connector carrier.

13. A multiple plug connector according to claim 12, wherein said frame consists of a U-shaped bracket with at least two end walls laterally overlapping sides of the U portion of said bracket, said end walls having guideways for each of said several plug-in members.

14. A multiple plug connector device according to claim 9, wherein each of said several plug-in members is connected to an actuating member which extends rearwardly beyond said frame to enable a displacement, from the rear of the multiple plug connector device, of respective ones of said several plug-in members.

15. A multiple plug connector device according to claim 14, wherein said frame has a recess between said actuating member and said frame for insertion of a tool at places at which said actuating members can be displaced.

16. A multiple plug connector device according to claim 15, wherein said frame has, at least at an upper end, a suspension member for fastening to another frame holding multiple plug connectors.

17. A multiple plug connector device according to claim 16, wherein one of said several plug-in members being at a lower part of said contact plug-in connector carrier is arranged firmly in said frame at a position in which joining of a plug member occurs when said multiple plug connectors press against said frame of said plug-in connector carrier.

18. A multiple plug connector according to claim 17, wherein said frame consists of a U-shaped bracket with at least two end walls laterally overlapping sides of the U portion of said bracket, said end walls having guideways for each of said several plug-in members.

19. A multiple plug connector device according to claim 14, wherein said frame has, at least at an upper end, a suspension member for fastening to another frame holding multiple plug connectors.

20. A multiple plug connector device according to claim 19, wherein one of said several plug-in members being at a lower part of said contact plug-in connector carrier is arranged firmly in said frame at a position in which joining of a plug member occurs when said multiple plug connectors press against said frame of said plug-in connector carrier.

21. A multiple plug connector according to claim 20, wherein said frame consists of a U-shaped bracket with at least two end walls laterally overlapping sides of the U portion of said bracket, said end walls having guideways for each of said several plug-in members.

22. A multiple plug connector device comprising a frame, and a contact plug-in connector carrier providing a plurality of contact plug-in connectors, wherein said contact plug-in connector carrier is divided into several plug-in members being separated by planes of division which are parallel to a direction of movement of said plug-in connectors within said frame, and wherein said several plug-in members are individually displaceable in the direction of movement within said frame, wherein each of said several plug-in members is connected to an actuating member which extends rearwardly beyond said frame to enable a displacement, from the rear of the multiple plug connector device, of respective ones of said several plug-in members and wherein said frame has a recess between said actuating member and said frame for insertion of a tool at places at which said actuating members can be displaced.

23. A multiple connector device for codable socket connectors with a plurality of plug pins, said device comprising a plurality of socket members each including a plurality of socket connections, and a common frame means for holding each of said plurality of socket members in relatively displaceable parallel positions with respect to one another, each of said socket members being individually movable within said frame means parallel to one another, wherein each of said socket members have a square cross-section and wherein said socket members are mounted in said frame means in positions with the socket connections of each socket member being selectively oriented by 90° with respect to one another.

* * * * *